US007180040B2

(12) United States Patent
Jones

(10) Patent No.: US 7,180,040 B2
(45) Date of Patent: Feb. 20, 2007

(54) CRIMP SPLICE FOR AN ELECTRICAL RESISTANCE HEATING CABLE

(75) Inventor: Thaddeus M. Jones, Bremen, IN (US)

(73) Assignee: MSX, Inc., South Bend, IN (US)

( * ) Notice: Subject to any disclaimer, the term of this patent is extended or adjusted under 35 U.S.C. 154(b) by 0 days.

(21) Appl. No.: 10/854,934

(22) Filed: May 27, 2004

(65) Prior Publication Data

US 2005/0274716 A1 Dec. 15, 2005

(51) Int. Cl.
*H05B 3/34* (2006.01)
*H01R 4/00* (2006.01)

(52) U.S. Cl. ..... 219/549; 174/84 C; 174/84 R; 174/90

(58) Field of Classification Search ..... 219/549, 219/528, 541, 544; 338/214; 439/578, 582; 174/73.1, 74 R, 84 C, 84 R
See application file for complete search history.

(56) References Cited

U.S. PATENT DOCUMENTS

| | | | | |
|---|---|---|---|---|
| 4,388,523 | A * | 6/1983 | Keep et al. | 219/541 |
| 4,391,425 | A * | 7/1983 | Keep, Jr. | 246/428 |
| 5,278,354 | A * | 1/1994 | Lhomme | 174/84 R |
| 5,941,482 | A * | 8/1999 | Santagata | 246/428 |
| 6,147,308 | A * | 11/2000 | Santagata | 174/75 R |
| 6,278,089 | B1 * | 8/2001 | Young et al. | 219/443.1 |
| 6,512,210 | B2 * | 1/2003 | Tanaka et al. | 219/541 |
| 6,529,686 | B2 * | 3/2003 | Ramanan et al. | 392/418 |
| 6,787,741 | B2 * | 9/2004 | Tanaka et al. | 219/541 |

* cited by examiner

*Primary Examiner*—Robin Evans
*Assistant Examiner*—Vinod Patel
(74) *Attorney, Agent, or Firm*—Taylor & Aust, P.C.

(57) ABSTRACT

An electrical resistance heating cable, including a resistance heating wire having a resistive conductor, an insulation at least partially surrounding said resistive conductor; and an end. A crimp connector is connected to the end. A thermally conductive sleeve at least partially surrounds the end and is positioned between the crimp connector and the insulation.

9 Claims, 3 Drawing Sheets

CRIMP SPLICE FOR AN ELECTRICAL RESISTANCE HEATING CABLE

BACKGROUND OF THE INVENTION

1. Field of the Invention

The present invention relates to electrical resistance heating cables, and, more particularly, to a crimp splice for an electrical resistance heating cable.

2. Description of the Related Art

Electrical resistance heating cables or traces are known that provide heat for a variety of applications. An electrical resistance heating cable can include a resistive conductor, such as a nickel chromium alloy wire, that for a given gauge cross-section provides a predetermined ohms/ft. and, for a given voltage, a predetermined watts/ft. heat output.

Construction of an electrical resistance heating cable in a coaxial form can include the resistive conductor surrounded by an electrically insulative but thermally conductive insulation. A ground braid can surround the insulation and there can be further insulation around the ground braid.

An application of an electrical resistance heating cable includes floor warming and heating. For example, a commercial floor drying system can use an electrical resistance heating cable to provide radiant heat and imbedded moisture sensors to solve a variety of indoor problems including: cleaning activities, condensation around walk-in freezers and refrigerators, food preparation areas, dishwashing areas, salad bars and sanitary facilities Other applications include electric pavement, floor or roof snow/ice melting, gutter deicing and freeze protection pipe trace applications. The heating cable can be used with automatic controls and sensors to operate heaters only while needed, based on conditions, to ensure minimal energy consumption, which is also true of previously mentioned applications.

Telecommunications applications of an electrical resistance heating cable or systems can include earth station satellite antenna deicing systems to ensure reliable operation of the antenna and reliable satellite signal reception and/or transmission by the antenna. Another telecommunication application can include broadcast antenna deicing such as for FM broadcast antennas. As with other applications, automatic deicing can be achieved using appropriate controllers and sensors.

IEEE (Institute of Electrical and Electronics Engineers) standard 515.1-1995 provides a recommended practice for the testing, design, installation, and maintenance of electrical resistance heat tracing (cable) for commercial applications. The standard provides specific test requirements for qualifying electrical resistance heating cables for commercial service and a basis for electrical and thermal design. The standard addresses heater characteristics and installation and maintenance requirements, and further, recommendations and requirements for unclassified heating cable applications are provided.

In use, an electrical resistance heating cable can have its two ends stripped of insulation to expose a portion of the resistive conductor at both ends. Each exposed end portion of the resistive conductor can be connected to a standard conductor such as an 18 AWG stranded conductor with insulation, for example, that allows for connection of the electrical resistance heating cable to an electrical power source. As with the resistive conductor, standard conductors typically have ends stripped of insulation to exposed the conductor wire. The ground braid of the electrical resistance heating cable can also be connected to a standard conductor to facilitate connection to ground.

Connection of the exposed end portions of the resistive conductor to the exposed wire of the standard conductors can be achieved by a crimp slice. However, the crimp tooling limits how close the electrical resistance heating cable insulation can be to the end of the standard conductor or the crimp connector. This tooling limitation creates a section of the exposed end portion of the resistive conductor that has an air gap between the resistive conductor insulation and crimped splice or standard conductor. Air can be a relatively poor heat conductor, particularly when compared to the electrical resistance heating cable insulation, and heat can build up in the vicinity of the air gap. Both of the resistive conductor and the electrical resistance heating cable insulation can potentially elevate in temperature, in the vicinity of the air gap, resulting in the resistive conductor going through the insulation and touching the ground braid thereby creating a ground fault, among other problems.

What is needed in the art is a device and method for crimping a resistive conductor of an electrical resistance heating cable to a standard conductor that dissipates heat in the vicinity of the air gap, while allowing for appropriate crimp tooling, and while also allowing safe and reliable construction and operation of the electrical resistance heating cable with compliance to industry standards where appropriate.

SUMMARY OF THE INVENTION

The present invention provides a device and method for crimping a resistive conductor of an electrical resistance heating cable to a standard conductor that dissipates heat in the vicinity of an air gap created between the end of the electrical resistance heating cable insulation and the end of the standard conductor or an end of a crimp connector.

The invention comprises, in one form thereof, an electrical resistance heating cable, including a resistance heating wire having a resistive conductor, an insulation at least partially surrounding said resistive conductor; and an end. A crimp connector is connected to the end. A thermally conductive sleeve at least partially surrounds the end and is positioned between the crimp connector and the insulation.

An advantage of the present invention is a device and method that dissipates heat in the vicinity of an air gap created between the end of the electrical resistance heating cable insulation the end of the standard conductor or crimp connector.

Another advantage of the present invention is that it allows for appropriate crimp tooling when making a connection between a resistive conductor of an electrical resistance heating cable and a standard conductor.

Yet another advantage is of the present invention is that it allows for crimp tooling for automated crimping when making a connection between a resistive conductor of an electrical resistance heating cable and a standard conductor.

A further advantage is of the present invention is that it allows safe and reliable construction and operation of the electrical resistance heating cable.

A yet further advantage is an electrical resistance heating cable compliant with appropriate industry standards, particularly, IEEE 515.1.

Another advantage is improved heat transfer in a crimp connection of an electrical resistance heating cable.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION OF THE INVENTION

Figure 1:
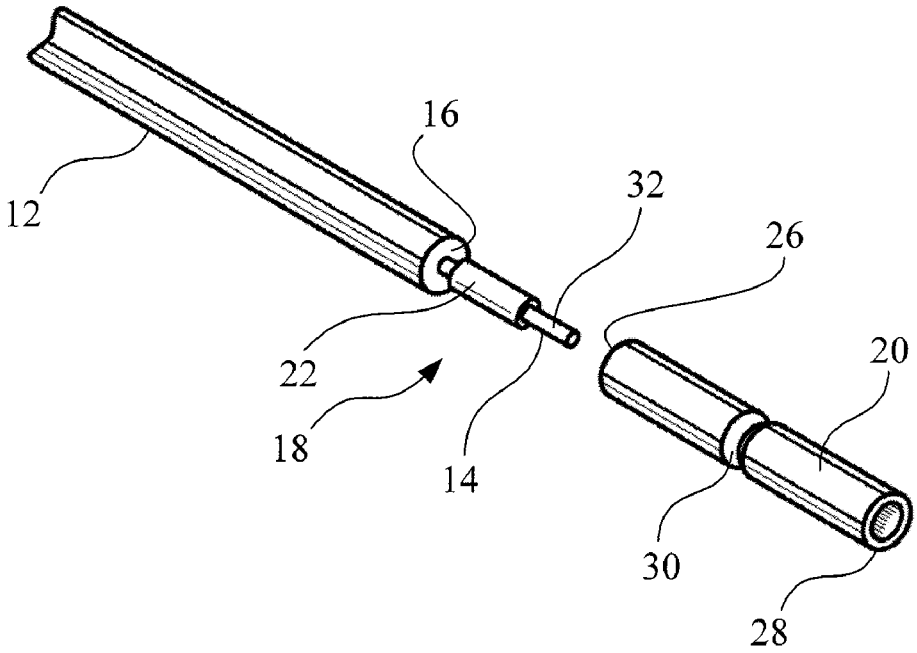
FIG. 1 is an exploded perspective view of an embodiment of an electrical resistance heating cable of the present invention illustrating a resistance heating wire, a thermally conductive sleeve and a crimp connector.
Figure 2:
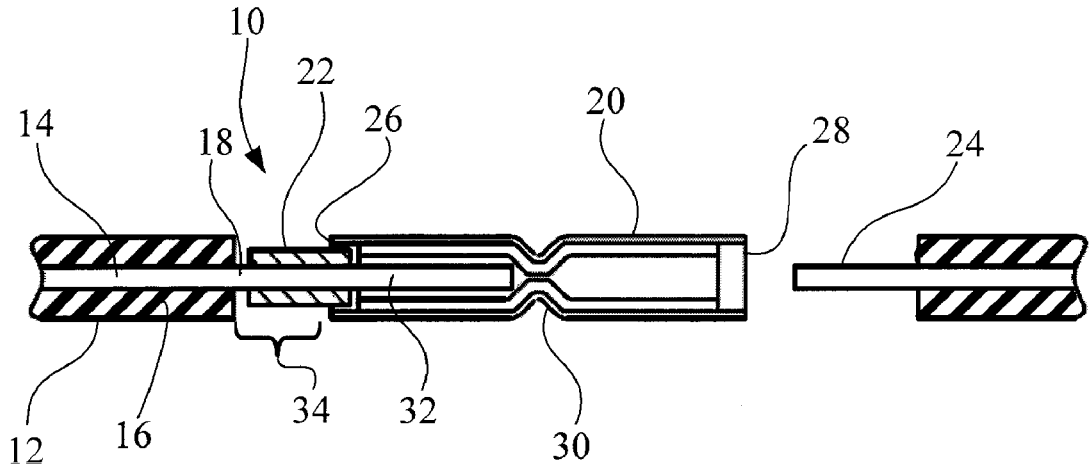
FIG. 2 is a sectional view of an embodiment of an electrical resistance heating cable of the present invention assembled with a thermally conductive sleeve and a crimp connector and in relation to a second conductor.

Referring now to the drawings, and more particularly to FIGS. 1 and 2, there is shown an electrical resistance heating cable 10 which generally includes a resistance heating wire 12 with a resistive conductor 14, an insulation 16 at least partially surrounding resistive conductor 14 and an end 18.

A crimp connector 20 is connected to end 18. A thermally conductive sleeve 22 at least partially surrounds end 18 and is positioned between crimp connector 20 and insulation 16. Crimp connector 20 can connect resistance heating wire 12 of electrical resistance heating cable 10 to second conductor 24 when second conductor 24 is inserted into crimp connector 20. Second conductor 24 can be another resistance heating wire or another type of conductor.

Crimp connector 20 can include first crimp end 26, second crimp end 28 and fold 30. To make a connection between resistance heating wire 12 and second conductor 24, resistance heating wire 12 is inserted into first crimp end 26, second conductor 24 is inserted into second crimp end 26 and crimp connector 20 is crimped at fold 30. Physical and electrical contact is made between crimp connector 20 and both resistive conductor 14 and second conductor 24 thereby connecting resistive conductor 14 of resistance heating wire 12 and second conductor 24. A heat shrink tubing (not shown in FIGS. 1 and 2) or other insulator can cover crimp connector 20.

The crimp tooling (not shown) can limit how close electrical resistance heating cable insulation 16 can be to an end of crimp connector 20. This tooling limitation creates a section of the exposed end 32 portion of resistive conductor 14 that has an air gap 34 between insulation 16 and the end of crimp connector 20 or second conductor 24. Air can be a relatively poor heat conductor, particularly when compared to insulation 16, and heat can build up in the vicinity of air gap 34. This heat build up in the vicinity of air gap 34 is counteracted by the present invention by providing thermally conductive sleeve 22 in the vicinity of air gap 34 to draw heat away from both resistive conductor 14 and insulation 16. The present invention thereby avoids a potential catastrophic elevation in temperature of resistive conductor 14 and/or insulation 16, and thereby avoids resistive conductor 14 going through insulation 16, among other problems.

Crimp connector 20 can be closely adjacent thermally conductive sleeve 22. Thermally conductive sleeve 22 can include at least one of a metal, a graphite and a ceramic. Crimp connector 20 includes a crimp connector end, as in first crimp end 26 or second crimp end 28, and thermally conductive sleeve 22 extends to the crimp connector end. Thermally conductive sleeve 22 can be received at least partially radially within crimp connector 20 as shown in FIG. 2. End 18 of resistance heating wire 12 can have a portion 32 of resistive conductor 14 exposed to an ambient air or other ambient atmosphere such as nitrogen, another inert gas, vacuum or some combination thereof. Second conductor 24 can be connected to crimp connector 20.

Thermally conductive sleeve 22 can be in the form of a cylinder, however sleeve 22 can include elliptical, square, triangular, polygonal and other varying cross-sections. Further, sleeve 22 can only partially surround resistive conductor 14. The present invention, as described above, includes an electrical resistance heating cable 10 compliant with IEEE 515.1-1995 standard.

In use, at least part of insulation 16 is stripped from end 18 of electrical resistance heating cable 10 thereby creating an exposed end 32 of resistive conductor 14. A thermally conductive sleeve 22 is located at least partially surrounding end 18 and is positioned between crimp connector 20 and insulation 16. Crimp connector 20 is crimped with thermally conductive sleeve 22 between insulation 16 and crimp connector 20. Thermally conductive sleeve 22 can be at least partially located around exposed end 32 of resistive conductor 14. Thermally conductive sleeve 22 can be located at least partially around at least part of insulation 16. Crimp connector 20 can be closely adjacent thermally conductive sleeve 22. Thermally conductive sleeve 22 can extend to an end of crimp connector 20. Thermally conductive sleeve 22 can be received at least partially radially within crimp connector 20.

Figure 3:
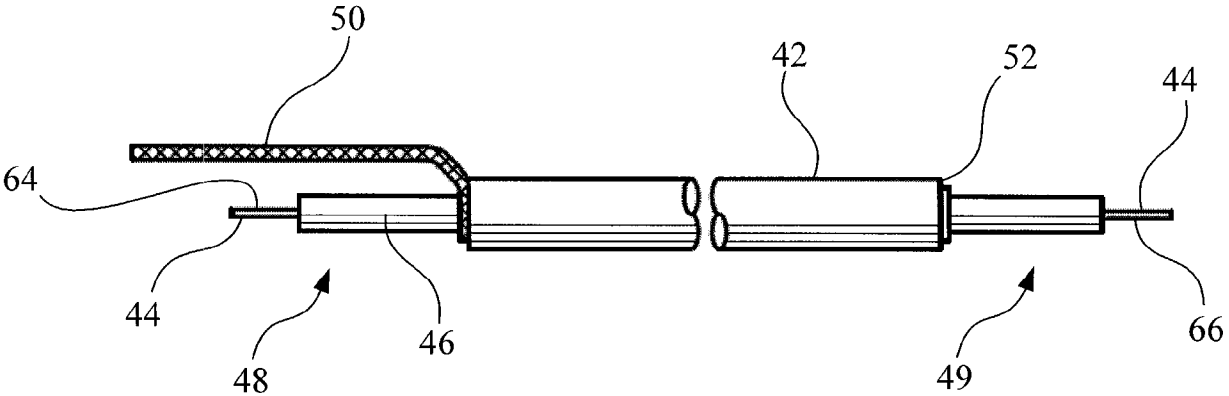
FIG. 3 is a front view of another embodiment of an electrical resistance heating cable of the present invention with a ground braid.

In another embodiment (FIGS. 3 and 4), electrical resistance heating cable 40 generally includes a resistance heating wire 42 with a resistive conductor 44, an insulation 46 at least partially surrounding resistive conductor 44 and at least one end 48, 49. Electrical resistance heating cable 40 further includes ground braid 50 and second insulation 52.

Figure 4:
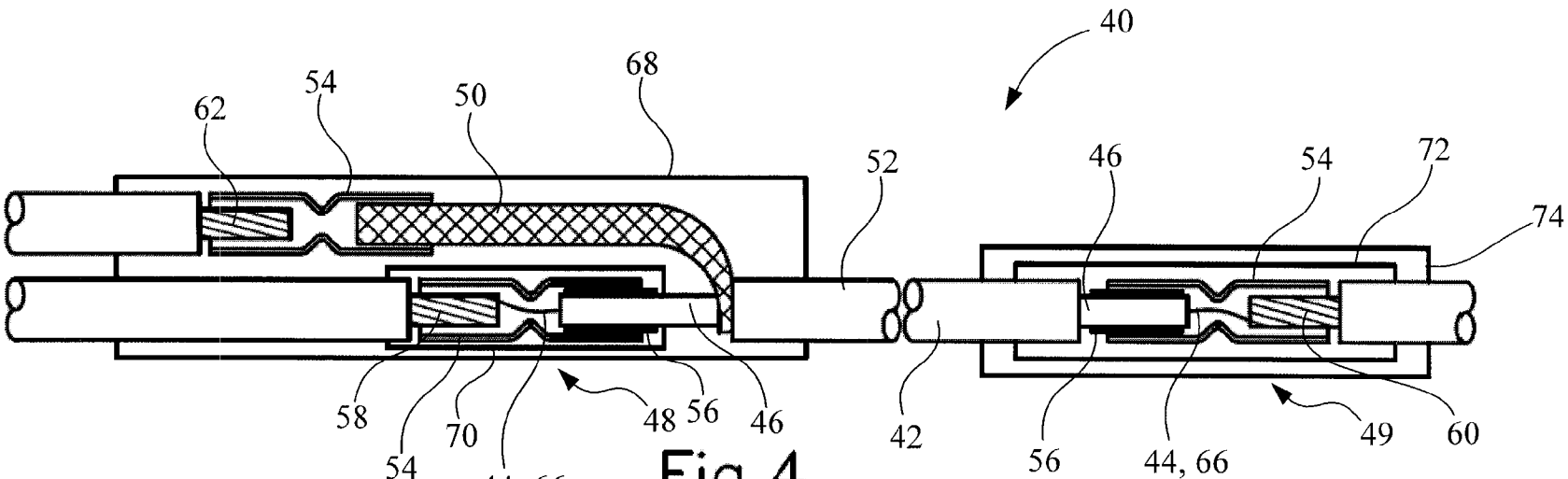
FIG. 4 is a partially sectional view of an embodiment of the crimp connection of the present invention using an electrical resistance heating cable with a ground braid as in FIG. 3.
Figure 5:
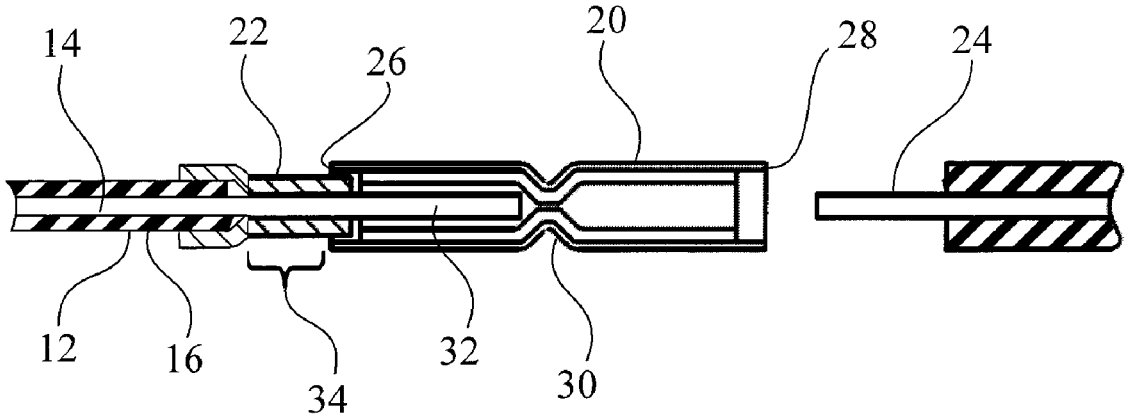
FIG. 5 is a sectional view of an embodiment of an electrical resistance heating cable of the present invention similar to FIG. 2 but with a thermally conductive sleeve at least partially around the insulation of the electrical resistance heating cable.

At least one crimp connector 54 is connected to at least one end of resistance heating wire 42, such as first end 48 and second end 49, and can also be connected to ground braid 50. At least one thermally conductive sleeve 56 at least partially surrounds at least one end 48, 49 and is positioned between crimp connector 54 and insulation 46. Crimp connectors 54 can connect ends 48, 49 to conductors 58, 60, respectively, similar to the crimp connector 20 configuration using thermally conductive sleeve 22 as shown in FIG. 2. Alternatively, crimp connectors 54 can connect ends 48, 49 to conductors 58, 60, respectively, as shown in FIG. 4 wherein first exposed end 64 of resistive conductor 44 is brought into contact with conductor 58 with thermally conductive sleeve 56 at least partially surrounding insulation 46 at first end 48, and second exposed end 66 of resistive conductor 44 is brought into contact with conductor 60 with thermally conductive sleeve 56 at least partially surrounding insulation 46 at second end 49. The embodiment of FIGS. 3 and 4 of the present invention function similarly to the embodiment of FIGS. 1 and 2 and the embodiment of FIGS. 3 and 4 achieve the stated advantages of the present invention. Conductors 58, 60 and 62 can provide hot, neutral and ground connections, respectively, to electrical resistance heating cable 40, for example.

Heat shrink tubing 68, 70, 72 and 74 can be used to protect and/or electrically isolate the various crimp connections. Alternatively, electrical tape (not shown) or other suitable elements can be used with and/or instead of heat shrink tubing 68, 70, 72 and 74.

Other variations are possible by combining elements of the configurations of FIGS. 2 and 4. For example, first end 48 can be in contact with conductor 58, as shown in FIG. 4, with thermally conductive sleeve 56 at least partially surrounding first exposed end 64 of resistive conductor 44, similar to thermally conductive sleeve 22 at least partially surrounding exposed end 32, as shown in FIG. 2. Other variations and combinations are contemplated.

The present invention can be used when electrical resistance heating cables are connected in series, parallel, Y and delta configurations, or some combination thereof. Multiple resistive conductors can be connected to a single end of a crimp connector and still stay within the scope of the present invention, likewise with multiple other conductors.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrical resistance heating cable, comprising:

a resistance heating wire including a resistive conductor, an insulation at least partially surrounding said resistive conductor; and an end;

a crimp connector connected to said end; and a thermally conductive sleeve at least partially surrounding said end and, said thermally conductive sleeve being at least partially radially within said crimp connector.

2. The electrical resistance heating cable of claim 1, wherein said end is an exposed end of said resistive conductor extending from said insulation.

3. The electrical resistance heating cable of claim 1, wherein said thermally conductive sleeve surrounds at least part of said insulation.

4. The electrical resistance heating cable of claim 1, wherein said crimp connector is crimped upon said thermally conductive sleeve.

5. The electrical resistance heating cable of claim 1, wherein said thermally conductive sleeve is comprised of at least one of a metal, a graphite and a ceramic.

6. The electrical resistance heating cable of claim 1, wherein said crimp connector includes a crimp connector end, said thermally conductive sleeve extends to said crimp connector end.

7. The electrical resistance heating cable of claim 1, wherein said end has a portion of said resistive conductor exposed to an ambient air.

8. The electrical resistance heating cable of claim 1, further including an electrical conductor connected to said crimp connector.

9. The electrical resistance heating cable of claim 1, wherein said thermally conductive sleeve is a cylinder.

* * * * *